United States Patent [19]

Sheehan

[11] 4,091,565

[45] May 30, 1978

[54] DECORATIVE TOY

[75] Inventor: Richard V. Sheehan, West Seneca, N.Y.

[73] Assignee: The Raymond Lee Organization, Inc., New York, N.Y.

[21] Appl. No.: 762,016

[22] Filed: Jan. 24, 1977

[51] Int. Cl.[2] ..... A63H 33/26

[52] U.S. Cl. ..... 46/238; 46/1 R

[58] Field of Search ..... 46/1 R, 236, 237, 238, 46/239, 240; 40/106.45; 35/7 A

[56] References Cited

U.S. PATENT DOCUMENTS

| | | | |
|---|---|---|---|
| 3,103,751 | 9/1963 | McDonald | 35/7 A |
| 3,118,669 | 1/1964 | Merrill | 273/1 |
| 3,874,102 | 4/1975 | Sheppard | 40/106.45 |
| 3,903,684 | 9/1975 | Wilson | 58/1 |

FOREIGN PATENT DOCUMENTS

| | | | |
|---|---|---|---|
| 2,339,351 | 3/1975 | Germany | 46/238 |

*Primary Examiner*—Louis G. Mancene
*Assistant Examiner*—Mickey Yu
*Attorney, Agent, or Firm*—Howard I. Podell

[57] ABSTRACT

A toy in the form of a figurine that extends vertically above a mounted platform with a rod extending from the figurine over the platform from which an object is suspended by a flexible string. A window opening in the top section of the platform encloses a transparent cover over a magnetized plate slidably mounted in a slot in the platform. The exterior face of the plate visible through the transparent cover, is marked with words describing a humorous weather forecast based on the behavior of the suspended object. The object contains an embedded magnet so that the object will rotate as it swings over the plate. The figurine is detachably attached to the platform so that both the figurine and the marked plate may be readily replaced with other figurines and marked plates.

1 Claim, 4 Drawing Figures

DECORATIVE TOY

SUMMARY OF THE INVENTION

My invention is a humorous toy in the form of a figurine that extends vertically above a mounted platform with a rod extending from the figurine over the platform from which an object is suspended by a flexible string. A window opening in the top section of the platform encloses a transparent cover over a magnetized plate slidably mounted in a slot in the platform. The exterior face of the plate visible through the transparent cover, is marked with words describing a humorous weather forecast based on the behavior of the suspended object. The object contains an embedded magnet so that the object will rotate as it swings over the plate. The figurine is detachably attached to the platform so that both the figurine and the marked plate may be readily replaced with other figurines and marked plates.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 4:
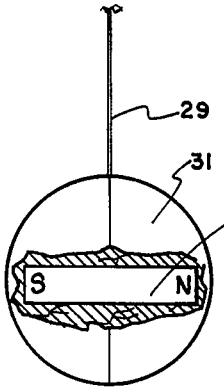
FIG. 4 is a sectional view of the ball.
Figure 1:
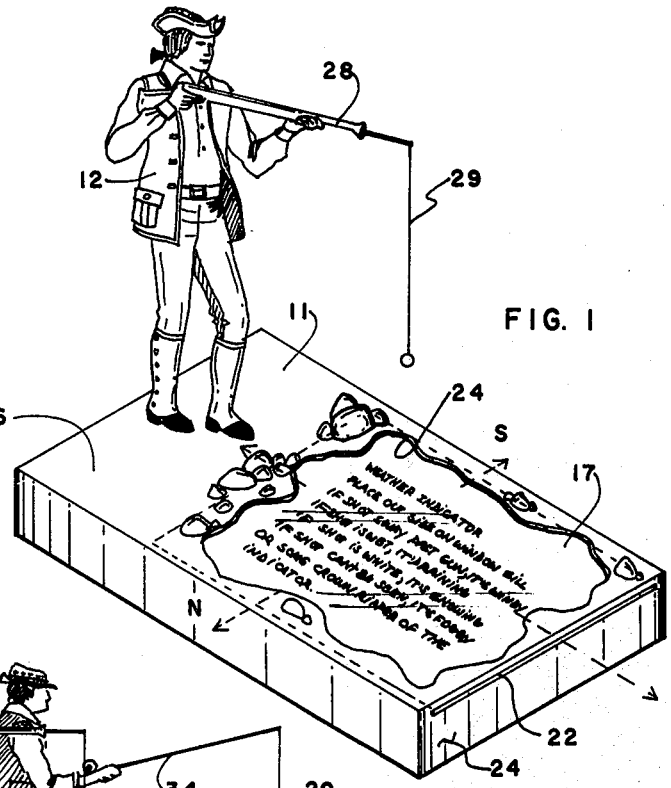
FIG. 1 is a perspective view of the assembled toy.
Figure 2:
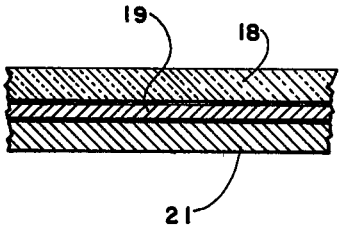
FIG. 2 is an exploded view of the toy.

Turning now descriptively to the drawings, in which similar reference characters denote similar elements throughout the several views, FIGS. 1–2 illustrate the toy 10 which is formed of a flat base 11 to which an erect figurine 12 is fastened. The figurine 12 is detachably fastened to the base 11 by means of a male screw threaded projection 14 engaged in a threaded hole 15 in the base 11. The top surface 16 of the base unit is formed with a window opening 17 with a transparent sheet 18 covering a printed sheet 19 of paper backed on a magnetized plate 21 displayed in said window opening.

A slot 22 extends from a vertical edge 24 of the base 11 along a plane parallel to the top surface 16 to form a recess extending below the window opening 17 and extending beyond the irregular shaped edges 24 of the window opening for housing of the transparent sheet 18, paper sheet 19 and magnetized plate 21. The sheet 18 is readily removed or replaced.

The figurine 12 is shaped with an extending horizontal object 28 such as a gun-like object, from the end of which a flexible string 29 is hung, with a ball-like object 31 tied to the free end of the string 29. A magnet 34 is embedded in the object 31 and interacts with the magnetic field of plate 21, when the object 31 is swung as a pendulum to cause the object 31 to rotate, when the string swings in the plane transverse to the magnetic axis of plate 21, and to cause the plane of swinging of the object 31 to rotate, when the object is initially swung in such a transverse plane.

Figure 3:
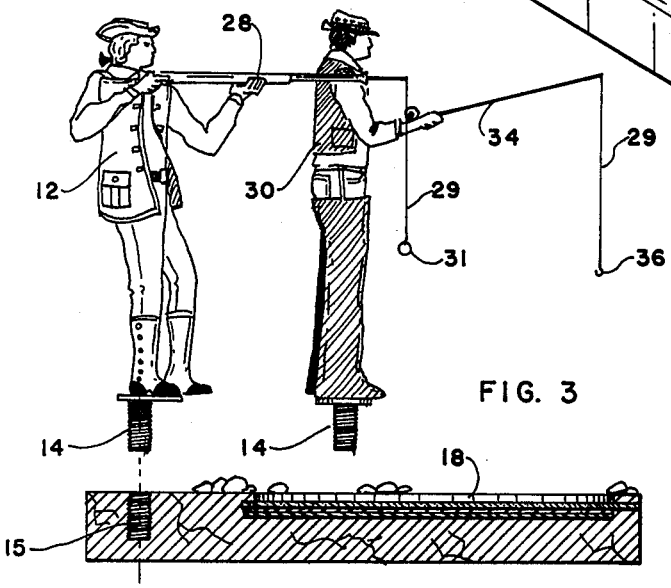
FIG. 3 is an alternate replaceable figurine.

Alternately, as shown in FIG. 3, a figurine 30 may be substituted for the figurine 12, with the figurine 30 shaped to hold a generally horizontally extended fishing pole 34, with a magnetized fishing hook shaped object 36 dangling from string 29 fixed to the end of pole 34.

The sheet of paper 19 may be marked with a humorous saying attributing weather predicting properties to the behavior of the object 34 or 36.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A toy formed of a base plate to which an erect vertical figure is detachably mounted, with a generally horizontal rod extending from said figure and with an object suspended by a flexible string fixed to the free end of said rod, said base formed with a window opening in the top surface in which a replaceable first sheet is displayed, the exposed face of which is covered by fixed markings, said first sheet backed by a magnetized second sheet of metal, and a transparent third sheet covering both first and second sheets, with the suspended object magnetized so as to interact with the magnetic field of the magnetized sheet, when the object is swung as a pendulum.

* * * * *